United States Patent [19]

White, Sr.

[11] 3,997,164

[45] Dec. 14, 1976

[54] ROAD HOCKEY PUCK

[76] Inventor: Thomas Paul White, Sr., 109 Gilbert St., Saint John, New Brunswick, Canada

[22] Filed: Jan. 2, 1973

[21] Appl. No.: 320,176

Related U.S. Application Data

[63] Continuation of Ser. No. 51,310, June 30, 1970, abandoned.

[52] U.S. Cl. ..... 273/128 R

[51] Int. Cl.[2] ..... A63B 71/00

[58] Field of Search ..... 273/128 A, 128 CS, 128 R, 273/106 R, 1 B; 272/59 B

[56] References Cited

UNITED STATES PATENTS

| | | | |
|---|---|---|---|
| 797,675 | 8/1905 | Fletcher | 273/128 R UX |
| 2,886,320 | 5/1959 | Van Heinnik | 273/128 R |

FOREIGN PATENTS OR APPLICATIONS

| | | | |
|---|---|---|---|
| 188,303 | 11/1923 | Australia | 273/26 R |
| 573,791 | 11/1924 | France | 272/59 B |
| 339,812 | 9/1921 | Germany | 272/59 B |
| 666,429 | 9/1938 | Germany | 272/59 B |

*Primary Examiner*—Anton O. Oechsle
*Assistant Examiner*—T. Brown
*Attorney, Agent, or Firm*—Cushman, Darby & Cushman

[57] ABSTRACT

A road hockey puck comprising discs attached to both sides of a larger resilient central member for guiding the resilient and more friction prone member over a hard surface. Several embodiments are disclosed for attaching the discs to the resilient member including a spool having a male member and a female member and a resilient member surrounding a portion of the spool. The male member comprises a disc having a shaft secured thereto and the female member comprises a disc having a sleeve. The shaft is constructed to be removably secured in the sleeve so that the shaft means and sleeve means can be placed through an aperture in the resilient member to hold the resilient member to the spool. The resilient member has a diameter greater than the discs of the male and female members so that it extends past the outer rim of the discs.

5 Claims, 13 Drawing Figures

INVENTOR

THOMAS PAUL WHITE, SR.

BY Cushman, Darby & Cushman

ATTORNEYS

Fig. 7.
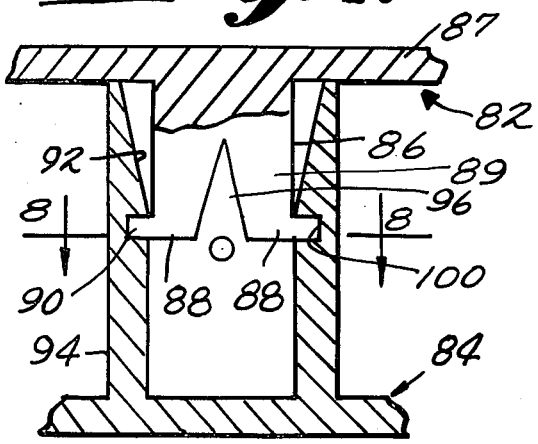
Fig. 8.
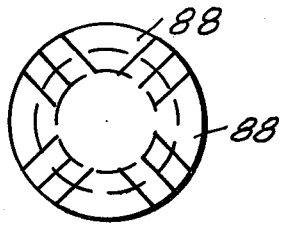
Fig. 9.
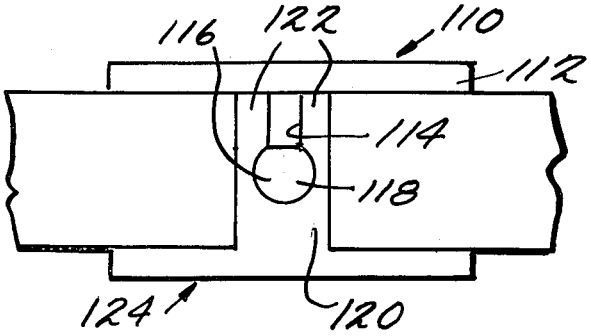
Fig. 10.
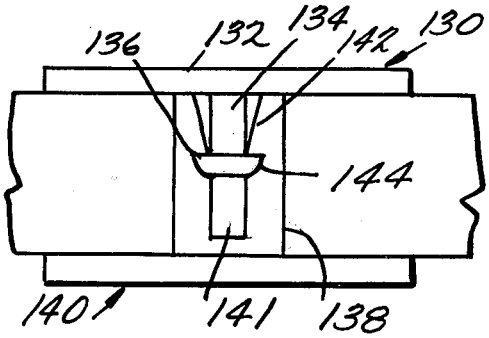
Fig. 11.
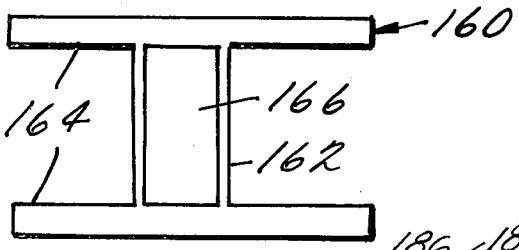
Fig. 12.
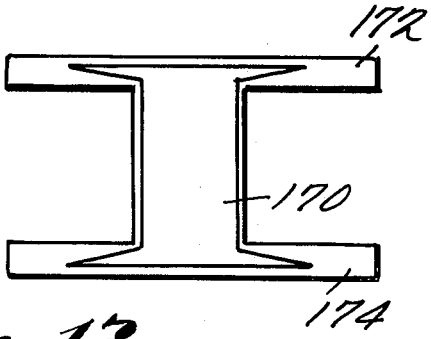
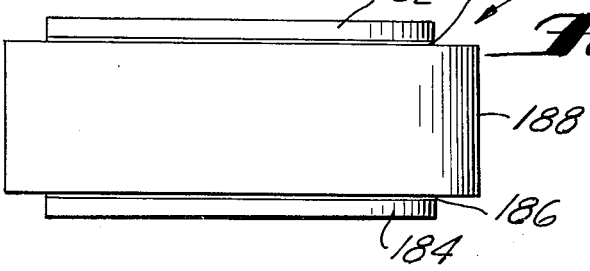
Fig. 13
INVENTOR
THOMAS PAUL WHITE, SR.
BY Cushman, Darby & Cushman
ATTORNEYS

ROAD HOCKEY PUCK

This is a continuation of application Ser. No. 51,310 filed June 30, 1970, and now abandoned.

This invention generally pertains to hockey pucks and specifically pertains to road hockey pucks used for playing on hard surfaces other than ice. The construction of the present invention provides a hockey puck which will behave essentially the same on hard surfaces or level areas as an ordinary puck would on ice, so that participants can shoot, pass, throw or lift the puck as they would in a conventional hockey game played on ice. The light weight of the puck invention and its resilient outer surface allow the hockey puck to be used in summer or in any other season. The light weight puck gives each individual, and especially youngsters, a chance to play in warm weather without the additional weight of protective clothing or protective equipment. The road puck enables an individual to practice in small restricted areas and is useful in developing ones arms and wrists while at the same time helping to improve the individual's skill in handling the puck by developing a person's coordination and agility. The use of the present invention is an improvement over present devices in that it can be safely used by youngsters and adults since contact of the puck with an individual's body will not cause the damage or injury that a puck of ordinary construction would. Besides the amusement aspect of the invention, the present hockey puck can be used to train hockey players or others interested in the game during all seasons of the year and is particularly useful in helping players develop their shooting skills so that more of their ice time can be used to develop their skating and playmaking, thus devoting more time to the functions of the game that have to be pursued on an ice surface.

The advantages thus stated and further advantages of the invention will appear more clearly from the following specification in connection with the accompanying drawings in which:

FIG. 7 is an enlarged fragmentary cross sectional view of still another embodiment of a spool used in the invention;

FIG. 8 is a section taken along lines 8—8 of FIG. 7;

FIG. 9 is a cross sectional view of another embodiment of the hockey puck invention;

FIG. 10 is a cross sectional view of still another embodiment of the hockey puck invention; and FIGS. 11 and 12 illustrate an additional embodiment of the hockey puck spool showing weight means in the spool;

FIG. 13 is a side elevation of another embodiment wherein the disks are adhered to the opposite faces of the foam rubber body with adhesive.

Figure 1:
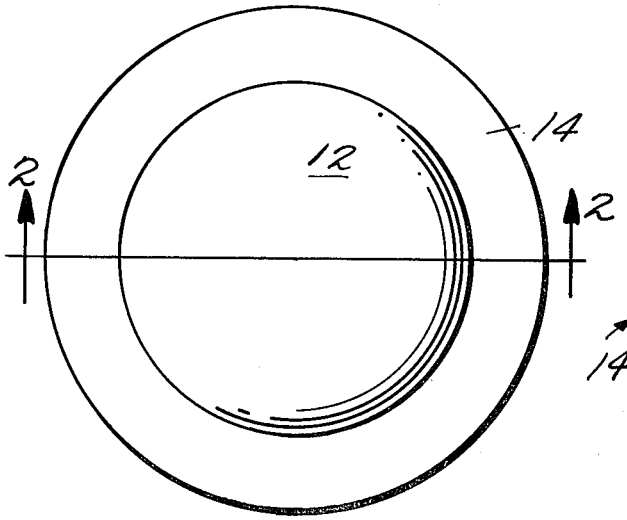
FIG. 1 shows a plan view of the hockey puck invention.
Figure 2:
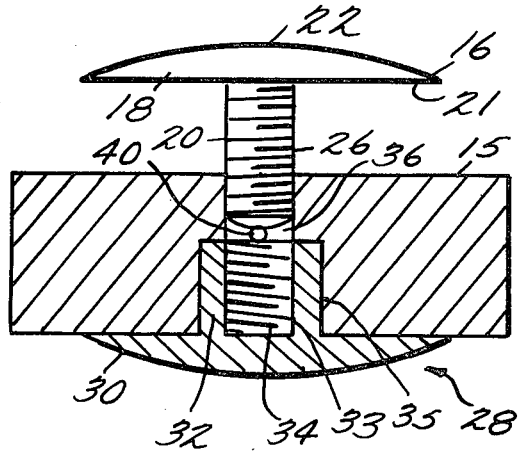
FIG. 2 is a cross sectional view taken along the lines 2—2 of the hockey puck shown in FIG. 1 showing one embodiment of the invention.
Figure 3:
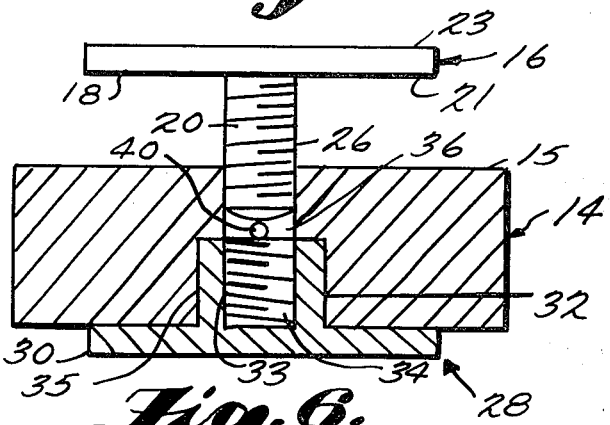
FIG. 3 is a cross sectional view taken along lines 2—2 of the hockey puck shown in FIG. 1 showing another embodiment of the invention.
Figure 4:
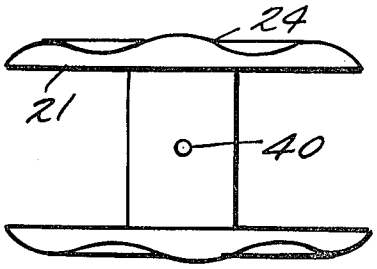
FIG. 4 is a cross sectional view of another embodiment of a spool used in the invention without the resilient member.

FIGS. 1, 2 and 3 disclose a road hockey puck comprising a spool 12 partially surrounded by a resilient member 14. The spool 12 is comprised of a male member 16 having an outer plate or disc 13 with shaft means 20 secured thereto or integrally constructed therewith. The plate or outer disc 18 is substantially perpendicular to the shaft means 20 and has a diameter which is substantially greater than the diameter of the shaft 20. The outer disc 18 is preferably circular in shape and may have a rounded outer surface 22 as shown in FIG. 2, a planar outer surface 23 as shown in FIG. 3, or an undulating or wave-like surface 24 as shown in FIG. 4. It should be noted in FIG. 4 that the central portion of both discs are higher than the edge undulations. The outer but smaller undulations lessen the tendency of the puck to rock on the central portion to an undesirable degree.

The inner surface 21 of each disc is preferably planar so that it will easily fit against its outer surface 15 of resilient member 14. The shaft means 20 is preferably threaded as shown at 26 in FIGS. 2 and 3 and is inserted into a female member 28 which is comprised of an outer plate or disc 30 having a sleeve or socket 32 secured thereto or integrally formed therewith. The sleeve or socket 32, in cooperation with the outer plate or disc 30, forms a recess or chamber 34. The inner surfaces 33 of the sleeve or socket 32 is preferably threaded as shown in FIGS. 2 and 3. Recess or chamber 34 is slightly larger than the diameter of shaft means 20 allowing the shaft means 20 to be threaded in the sleeve 32 causing the male segment 16 to be firmly secured to the female segment 28.

Surrounding the outer surface 35 of sleeve 32 and shaft 20 is a resilient member 14. The resilient member 14 has an aperture 36 therethrough which is of such a diameter that the sleeve or socket 32 can be inserted therein in a snug relationship. If desired, the aperture can have a varying diameter in step construction so that shaft 20 and sleeve 32 can snugly fit against the resilient member 14. The spool body 12, comprised of male member 16 and female member 28, may be fabricated of heavy plastic with one member being made heavier than the other so that the hockey puck may have a lower center of gravity which tends to keep the puck from flipping when passed. If desired lighter plastics such as nylon or other moldable material can be used. These lighter materials can be made heavier by inserting weights therein.

As shown in FIGS. 2, 3 and 4, the outer plates or discs are generally equal in thickness and have a substantially circular outer rim or circumference. However, the female disc member may be made somewhat thinner than the male disc member since, after assembly, the combined male and female portions would throw the center of gravity away from the core of the mass unless some compensation is provided. Because of this construction the center of gravity will remain as near as possible to the actual core of the mass as shown by the numeral 40 in the preferred exemplary embodiments. The resilient member 14 has a diameter which is substantially greater than the outer diameter of discs 18 and 30 so that it extends past the outer rims of the discs and will strike a surface before the spool hits the surface. While the resilient member is preferably made of sponge rubber, any other suitable material may be used.

Figure 5:
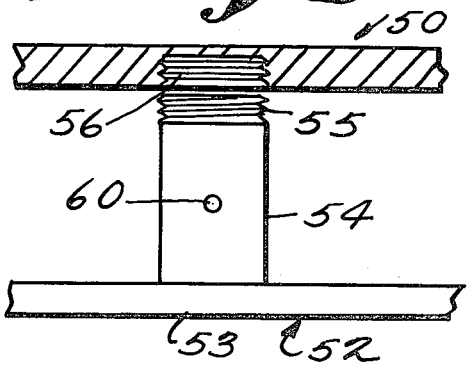
FIG. 5 is an enlarged exploded cross sectional view of yet another embodiment of a spool used in the invention.

FIG. 5 discloses a hockey puck spool having a female member 50 and a male member 52. The male member has an outer plate or disc 53 having shaft means 54 secured thereto and is preferably threaded at only one end 55. However, if desired, the shaft can be threaded at either end. The female member 50 preferably has a sleeve or socket 56 cut therein and is threaded to receive the threaded end 55 of shaft means 54. While FIG. 5 shows sleeve 56 cut in female member 50 the outer plates or discs 50 and 52 can each have a sleeve cut therein to receive either of the threaded shaft ends. The core of the mass of the spool is shown at 60.

FIGS. 6, 7, 9 and 10 show other modifications of the invention whereby the hockey puck spool can be fastened together.

Figure 6:
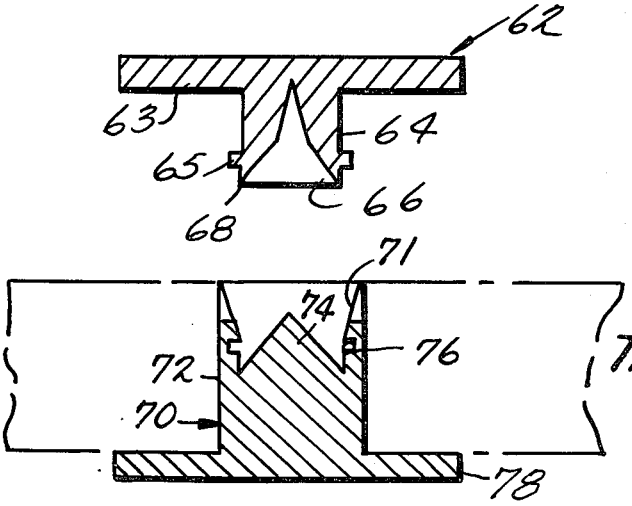
FIG. 6 is an enlarged exploded cross sectional view of another embodiment of the invention.

FIG. 6 discloses a male member 62 having an outer plate or disc having a shaft 64 projecting therefrom. The shaft 64 has a substantially conical chamber or recess 66 therein and a rib or flange 65 around its outer surface. When the male member 62 is inserted into the female member 70 the end 68 of shaft 64 engages the inclined or beveled extensions or edges 71 of sleeve 72 and is directed downward until a substantially conical projection 74 located at the base of the sleeve engages the substantially conical chamber or recess 66 of the male member causing the rib or flange 65 of shaft 64 to be snapped into an annular channel or groove 76 cut in the inner surface of sleeve 72; the sleeve being secured to outer disc or plate 78.

FIG. 7 shows a fragmentary enlarged cross-section of another embodiment of the pack spool comprising a male member 82 and a female member 84. The male member 82 has a shaft 86 extending from its outer plate, or disc 87 and is cut into a plurality of parts 88, as shown in FIGS. 7 and 8. Each of the segments 88 comprises a leg 89 ending in a foot or flange 90. The male member 82 is connected to the female member 84 by forcing the feet or flanges 90 of the legs 89 down the inclined or beveled inner surface 92 of sleeve 94 so that they are compressed inward into chamber 96 until the feet 90 pass the inclined inner surface 92 and snap into an annular groove 100 on the inner surface of the sleeve and regain their original configuration.

FIG. 9 shows a fragmentary cross-section of another spool embodiment of the invention. The male member 110 has an outer plate or disc 112 having an integral shaft 114 projecting therefrom in a substantially perpendicular manner ending in a ball or semi-spherical projection 116. The shaft end 116 can be of any configuration as long as it has a substantially greater diameter than the shaft. The preferred end construction is substantially ball-shaped and is inserted into a necked chamber 118 defined by the particular construction of sleeve 120. When the ball end 116 of shaft 114 is forced down into sleeve 120 of female member 124, the sleeve extensions or side walls 122 which define the neck resiliently move outward or away from the ball and the ball 116 snaps into the chamber 118.

FIG. 10 illustrates another embodiment in which the male member 130 has a disc or outer plate base 132 upon which a shaft 134 is substantially perpendicularly mounted or secured. The shaft 134 preferably has an integral end or head 136 which forms a substantially T-shaped body with the shaft. The head 136 of shaft 134 enters the sleeve 138 of female member 140 and travels downward into the substantially conical chamber 141 contacting the inclined inner surface 142 of sleeve 138 and expanding the walls of sleeve 138 until the head 136 snaps into place into a substantially arcuate annular groove 144 cut into the inner surface of sleeve 138.

FIGS. 11 and 12 illustrate additional embodiments of the invention in which the shaft 162 of spool 160 can be weighted by weight 166 so that the hockey puck weight is increased while retaining the yielding properties of the puck. As shown by FIG. 11, the shaft or shank 162 is made of heavier material than the discs or outer plates 164. If desired, however, one of the discs can singularly be made heavier.

In FIG. 12 the hockey puck is weighted by spilling the weight 170 partially out into discs 172 and 174 for the same purpose as previously set forth. As previously stated, another way of increasing the hockey puck weight is simply to make one of the discs heavier.

Most of the embodiments described above involve male and female fittings respectively attached or integrally formed with the discs for facilitating effective attachment of the discs to the opposing faces of the resilient member. However, it should be noted that the discs may also be attached with screws, nails, rivets, adhesives, moulding and the like without need for the discs to take on any special attachment structure. In FIG. 13 the road hockey puck embodiment illustrated at 180 is constituted by disks 182, 184 adhered by adhesive 186 to opposite faces of the foam rubber body 188. Alternatively, in each of the discs there may be provided a male member with the mating female portion being formed in the resilient member itself. Numerous other schemes for attaching the two discs to the resilient member will be apparent to those skilled in the art after carefully studying the foregoing specifically disclosed embodiments. The discs may be made of heavy or lightweight plastics or any other suitable material.

Although the present invention has been described and illustrated in connection with various embodiments, it is to be understood that modifications and variations may be resorted to without departing from the spirit of the invention, as those skilled in the art will readily understand. Such modifications and variations are considered to be within the purview and scope of the present invention as defined by the appended claims.

What is claimed is:

1. A road hockey puck comprising:

a spool having a female member and a male member, said female member comprising a disc having sleeve means secured thereto, said male member comprising a disc having shaft means secured thereto, said shaft means having a plurality of leg segments defining a substantially cone-shaped recess, each of said leg segments having a flange, and said sleeve means having inclined inner walls to guide said flanged legs and an annular groove positioned therein to hold said flange, and a resilient arcuate member having an aperture therein surrounding at least a part of said spool and having a diameter greater than said discs.

2. A road hockey puck, comprising:

first and second, axially spaced disks;

a generally cylindrical body of spongy, resilient material having a greater diameter than said disks, said body having two opposite end faces;

means retaining the first and second, axially spaced disks in coaxial alignment with said body and juxtaposed upon respective ones of the two opposite end faces of said body;

the puck having this restriction as to weight, as to mass distribution, and as to surface characteristics of the first and second, axially spaced disks: that the puck will be able to be shot, passed thrown and lifted essentially the same on hard surfaces, in the game of road hockey, as a conventional ice hockey puck, on ice, in the game of ice hockey; and the puck having this further restriction: that the outer periphery of the body protrudes sufficiently radially beyond the outer peripheries of the first and second axially spaced disks and is of such resiliency, that players clad in summertime street clothes when struck by the puck in level flight during the playing of conventional road hockey with said puck will not normally be injured, when they would be were they using a conventional ice hockey puck;

the retaining means comprising male and female connectors secured to a respective one of said discs and projecting from the face of the disc adjacent the main body, said male and female connectors being engageable with one another in means defining an aperture extending through said main body.

3. A road hockey puck according to claim 2 wherein said male and female connectors comprise respective male and female elements of a snap connector.

4. The road hockey puck of claim 2 wherein one of said disks is internally weighted with a heavier material than that of which the remainder of said disks is constituted.

5. The road hockey puck of claim 2 wherein the male and female connectors are respectively threaded for mutual threaded engagement.

* * * * *